US009955740B2

(12) United States Patent
Bruce

(10) Patent No.: US 9,955,740 B2
(45) Date of Patent: May 1, 2018

(54) EMERGENCY ANTI-HYPOTHERMIA SYSTEM AND HIGHLY PORTABLE, INFLATABLE EMERGENCY VEST THEREFOR

(71) Applicant: Ian A. Bruce, Deer Isle, ME (US)

(72) Inventor: Ian A. Bruce, Deer Isle, ME (US)

( * ) Notice: Subject to any disclaimer, the term of this patent is extended or adjusted under 35 U.S.C. 154(b) by 183 days.

(21) Appl. No.: 14/979,943

(22) Filed: Dec. 28, 2015

(65) Prior Publication Data

US 2017/0181482 A1 Jun. 29, 2017

(51) Int. Cl.

| | |
|---|---|
| ***A41D 1/04*** | (2006.01) |
| ***A41D 31/00*** | (2006.01) |
| ***A41D 27/28*** | (2006.01) |

(52) U.S. Cl.

CPC ..... *A41D 1/04* (2013.01); *A41D 27/28* (2013.01); *A41D 31/0033* (2013.01); *A41D 2400/14* (2013.01); *A41D 2400/42* (2013.01)

(58) Field of Classification Search

CPC ..... A41D 1/04; A41D 27/08; A41D 31/0033; A41D 2400/20; A41D 2400/10

USPC ..... 2/102, DIG. 3, DIG. 1

See application file for complete search history.

(56) References Cited

U.S. PATENT DOCUMENTS 1,640,270 A 8/1927 Furman
2,639,432 A 5/1953 Kaplan
3,266,070 A 8/1966 O'Link
3,495,274 A 2/1970 Isaacs
3,771,170 A * 11/1973 Leon ..... A41D 13/0155 2/97
3,921,944 A 11/1975 Morrison
4,017,908 A * 4/1977 Murnane ..... A41D 13/0125 2/114
4,181,993 A * 1/1980 McDaniel ..... B63C 9/125 441/108
4,185,327 A * 1/1980 Markve ..... A41D 13/0156 2/456
4,242,769 A * 1/1981 Rayfield ..... A41D 13/002 2/79
4,270,227 A * 6/1981 Wolfe ..... A41D 27/28 2/87
4,370,754 A * 2/1983 Donzis ..... A41D 13/0153 2/16
4,547,906 A * 10/1985 Nishida ..... A41D 13/002 135/115
4,576,087 A * 3/1986 Wolfe ..... A41D 27/28 2/87
5,072,455 A 12/1991 St. Ours
5,302,806 A 4/1994 Simmons et al.
(Continued)

*Primary Examiner* — Alissa L Hoey
(74) *Attorney, Agent, or Firm* — Anthony D. Pellegrini

(57) ABSTRACT

An emergency anti-hypothermia system has a thermally insulating vest that is sufficiently portable to be carried for emergency use in a pocket, purse, backpack, compartment of a vehicle, ski pole or other location, with the vest providing thermal insulation by being made with thermally insulating air impervious material that also provides for its inflation. A multiplicity of interconnected inflated chambers situated about the vest, provides thermal insulation by anti-conduction, anti-radiation and anti-convection in a highly portable system. An outer surface having radar reflective properties further improves visibility of the vest.

45 Claims, 5 Drawing Sheets

(56) References Cited

U.S. PATENT DOCUMENTS 5,303,425 A * 4/1994 Mele ..... A41D 13/0053 2/102
5,546,602 A * 8/1996 Hale ..... A41D 13/0155 128/874
5,603,648 A 2/1997 Kea
5,787,502 A * 8/1998 Middleton ..... A41D 31/0038 2/2.15
5,799,329 A 9/1998 Hauschild
5,867,843 A 2/1999 Robello et al.
5,970,519 A * 10/1999 Weber ..... A41D 13/0025 2/102
6,004,177 A 12/1999 Biesecker et al.
6,112,327 A * 9/2000 Shaffer ..... A41D 7/003 2/67
6,128,784 A * 10/2000 Frank ..... A41D 13/0053 2/102
6,374,413 B1 * 4/2002 Magee ..... A41D 1/002 2/1
6,589,088 B1 7/2003 Maness
6,666,622 B1 12/2003 Courtney et al.
6,864,858 B1 3/2005 Miller et al.
6,910,229 B2 * 6/2005 Raithel ..... A41D 13/002 2/456
7,013,489 B1 3/2006 McGrath
7,276,076 B2 * 10/2007 Bieberich ..... A61F 7/00 607/104
7,364,584 B2 * 4/2008 Anderson ..... A61F 7/02 607/108
7,370,370 B2 5/2008 Colombo
7,490,361 B1 * 2/2009 Floyd ..... A41D 13/0512 2/94
7,819,911 B2 * 10/2010 Anderson ..... A61F 7/00 607/104
7,862,599 B2 * 1/2011 Anderson ..... A61F 7/0097 607/104
7,891,019 B2 * 2/2011 Goldfine ..... A41D 13/0051 2/69
8,359,665 B2 1/2013 Bruce
8,454,672 B2 * 6/2013 Van Duren ..... A61F 7/0097 607/108
9,688,370 B1 * 6/2017 Shiue ..... B63C 9/1255
2003/0106142 A1 * 6/2003 Raithel ..... A41D 13/002 2/455
2003/0182708 A1 * 10/2003 Gathings, Jr. ..... A41D 3/02 2/97
2003/0195596 A1 * 10/2003 Augustine ..... A61F 7/00 607/104
2006/0070162 A1 * 4/2006 Frank ..... A41D 13/0025 2/69
2006/0174392 A1 * 8/2006 Farnworth ..... A41D 13/0025 2/102
2008/0249276 A1 * 10/2008 Alder ..... B32B 27/00 528/10
2010/0015373 A1 * 1/2010 Lin ..... A41D 31/0038 428/36.1
2010/0071113 A1 * 3/2010 Hamilton ..... A41D 13/002 2/102
2010/0199405 A1 * 8/2010 Nelson ..... A41D 13/0051 2/102
2011/0296580 A1 * 12/2011 Demarest ..... A41D 27/28 2/69
2012/0144551 A1 * 6/2012 Guldalian ..... A61B 5/04085 2/102
2012/0167288 A1 * 7/2012 Chen ..... A62B 17/005 2/458
2014/0310847 A1 * 10/2014 Ulriksen ..... A41D 27/28 2/69
2015/0082523 A1 * 3/2015 Wyner ..... B32B 3/04 2/455
2015/0327602 A1 * 11/2015 Nelson ..... F24F 3/1411 2/102
2017/0099898 A1 * 4/2017 Pezzimenti ..... A41D 27/28

* cited by examiner

EMERGENCY ANTI-HYPOTHERMIA SYSTEM AND HIGHLY PORTABLE, INFLATABLE EMERGENCY VEST THEREFOR

BACKGROUND OF THE INVENTION

Every winter, drivers are stranded on roads, run the engines of their vehicles until they run out of gas or other vehicle fuel, and then are subjected to hypothermia while they wait for assistance at a location to which they have not brought sufficiently insulating clothing. Skiers or others participating in winter outdoor activities may similarly dress for a planned short time outside, but then fall or otherwise become caught by unexpected conditions that lead to exposure to cold sufficient to produce hypothermia. Still others may find themselves in such conditions with insufficient clothing insulation. Hypothermia is a danger to victims of natural disasters, and even to persons simply changing a tire on a roadside in winter night.

Hypothermia is defined as the unintentional lowering of the deep body (core) temperature below 95.0° F. (35.0° C.). Hypothermia can be mild, moderate, or severe. According to the CDC, 10,649 deaths were attributed to weather-related causes in the United States during the period from 2006 through 2010. Two-thirds of these deaths were attributed to excessive natural cold. (See: Deaths Attributed to Heat, Cold, and Other Weather Events in the United States, 2006-2010; http://www.cdc.gov/nchs/data/nhsr/nhsr076.pdf).

Since 1999, the CDC's National Center for Health Statistics (NCHS) has used information from death certificates categorized with International Classification of Diseases codes to estimate national mortality trends. During 1999, exposure to excessive natural cold (ICD-10 code X31) was listed as the underlying cause of death for 598 persons in the United States, and hypothermia (ICD-10 code T68) was listed as a nature of injury in 1,139 deaths. Of the 598 hypothermia-related deaths, 380 (64%) occurred among males, and 359 (60%) of the 597 persons who died of hypothermia and whose age was known were aged >65 years. During 1999, Pennsylvania and New York had the greatest number of hypothermia-related deaths (36 each), and Alaska had the highest death rate (1.9 per 100,000 population), approximately twice that of Montana, which had second-highest rate (0.9).

Hypothermia during cold weather is the result of decreased heat production, increased heat loss, or impaired thermoregulation. Older persons, who have a decreased basal metabolic rate, might be at further risk for hypothermia because of impaired physical exertion, which produces heat to keep the body warm. Inactivity limits heat production through physical exertion, but overexertion can increase evaporation from the respiratory tract and cause fatigue. Shivering also can cause enough lactate generation eventually to produce acidosis and fatigue. Exposure to high winds can further increase heat loss. As body temperature decreases, the hypothalamus fails to compensate body temperature, and the central nervous system follows the progressive systemic depression of metabolism. Finally, metabolic impairment from alcoholism, malnutrition, hypothyroidism, or advanced age can cause poor endurance to cold. Children, who have a much greater surface—are to metabolic mass, are at even greater risk from hypothermia.

Hypothermia-related morbidity is not exclusive to cold northern climates. Hypothermia can occur in cold and warm climates alike. In fact, a survey of 12 medical centers found that the greatest number of cases of accidental hypothermia occurred in warmer states. Hypothermia has been reported in tropical countries as well. Persons from regions with warmer winters might be at greater risk from the indirect effects of cold weather than persons from regions with colder and longer winters because of inexperience in dealing with cold temperatures. However, geographic distributions might represent not only seasonal temperature variations but also socioeconomic status (which can limit access to controlled indoor temperature), cultural backgrounds (which can influence behavior toward individual protection from cold as well as outdoor activity), or populations with a higher proportion of elderly persons.

The foregoing indicates that an emergency anti-hypothermia system for such conditions is needed. The present invention provides such a system. It provides a thermally insulating inflatable vest that is sufficiently portable to be carried for emergency use in a pocket, purse, backpack, or other such location on a person, or also in a compartment of a vehicle.

The vest provides thermal insulation by being made with air impervious material that also provides for its inflation. The inflating air also provides insulation. Thermal radiation reflective material on inwardly facing surfaces of the vest, preferably inwardly facing surfaces of outer layers of inflated chambers or cells about the vest, serves to retain body heat. The multiplicity of individual inflatable chambers about the vest reduces convection heat transfer. The vest thus preferably provides thermal insulation by anti-conduction, anti-radiation and anti-convection in a highly portable system.

Various other features and attendant advantages of the present invention will become obvious to the reader and become fully appreciated as the same becomes better understood when considered in conjunction with the accompanying drawings. It is intended that these objects and advantages are within the scope of the present invention. To the accomplishment of the above and related objects, this invention may be embodied in the form illustrated in the accompanying drawings. Attention being called to the fact, however, that the drawings are illustrative only, and that changes may be made in the specific construction illustrated and described within the scope of this application.

SUMMARY OF THE INVENTION

A highly portable, inflatable emergency vest is provided. The vest contains cells, or chambers, which are cross-connected and inflated trough a simple one-way mouthpiece on the vest's collar. Inflating the vest creates a layer of trapped, still air in much the same way as does goose down, while conforming to the shape of the wearer, thus insulating the wearer's body core while allowing moist air to escape through the arm holes and through the integrated vent holes. The interior surface of the vest is thermally reflective, thereby keeping body heat trapped next to the user and preventing as much as 80% to 90% of radiant heat loss. The exterior surface of the vest further is made of radar reflective material. This greatly increases the radar visibility of the vest, to aid in search and rescue efforts to locate a wearer who has become lost or incapacitated. This feature is also useful by operators of small boats and kayaks as it permits positive radar indication of the wearer's location on the surface of large bodies of water from long distances.

The manufacturing process involves placing a first sheet of material onto a second sheet and then bonding the two sheets together along the edges and interiorly by either thermally or ultrasonically welding the first sheet to the second sheet to form the interconnected chambers. The sheets may be preprinted in any preferred color(s) and with any sort of decorative elements desired, through offset printing or other known means. Adhesive strips are attached to the vest for closures. Once assembled, the uninflated vest may be stored in small container or pouch for easy portability. For safety/high-visibility applications, reflective ink for textiles may be used. Such inks are composed of a water-based (latex) ink base combined with retro-reflective microlenses. This process is used for direct screen printing onto fabric or plastics, and the end result with respect to visibility is the same. Retro-reflective films may also be used, being applied to the outside sheet before or after the bonding process.

Other features and advantages of the present invention are described below.

DESCRIPTION OF THE DRAWINGS

Preferred embodiments will now be described with respect to the following drawings that illustrate but do not limit the invention.

DETAILED DESCRIPTION OF PREFERRED EMBODIMENTS

Figure 1:
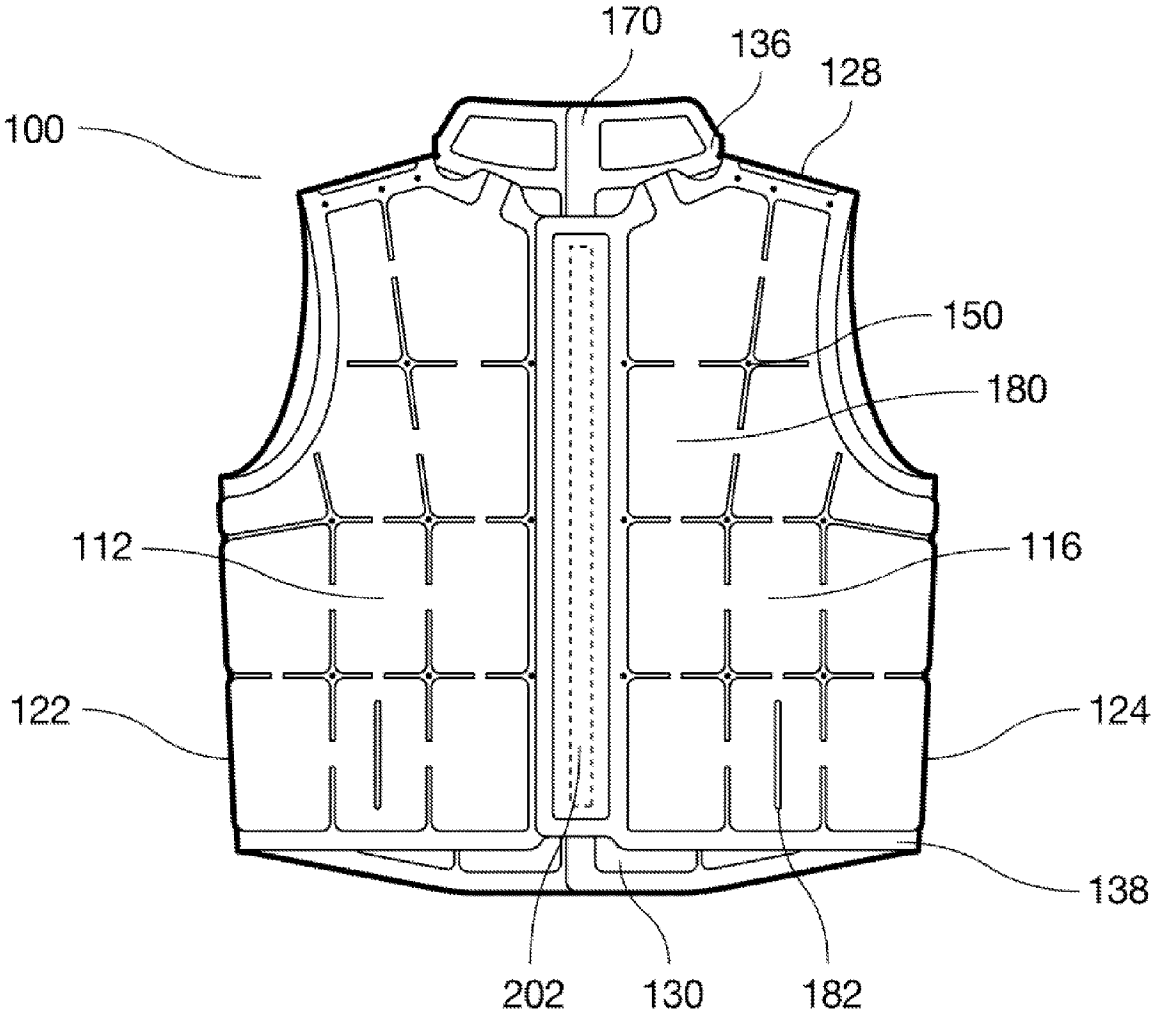
FIG. 1 is a depiction of one embodiment of the vest of the present invention.

The present invention discloses an emergency anti-hypothermia system. In one embodiment, the system comprises an inflatable vest 100. See FIG. 1. The vest 100 is made with air impervious material such that air introduced to the interior of the vest 100 is contained therein, thus inflating at least a portion of the vest 100. Preferably, the vest 100 is made from a high tensile-strength polyester film, such as aluminized nylon sheet, coated on one side with polyethylene and metalized on the other). The material is electrically resistant, chemically stable, noncombustible (94VTM-2), and comes in thicknesses ranging from 0.001 inches to 0.014 inches. It is a thermoplastic polymer, and is thermally and ultrasonically fusible. It may come in colors from matte to metalized.

The vest 100 is structured with a closeable front 110, substantially full sides 122,124 of the vest 100, and a substantially full back 130 extending from the neck area 136 to the waist area 138 of the vest 100. The vest 100 moreover has an outer surface and an inner surface, with there being thermal radiation reflective material on at least a portion of the inner surface of the vest 100. When inflated, the vest 100 is thermally insulating around the front 110, sides 122,124, and back 130.

Figure 3:
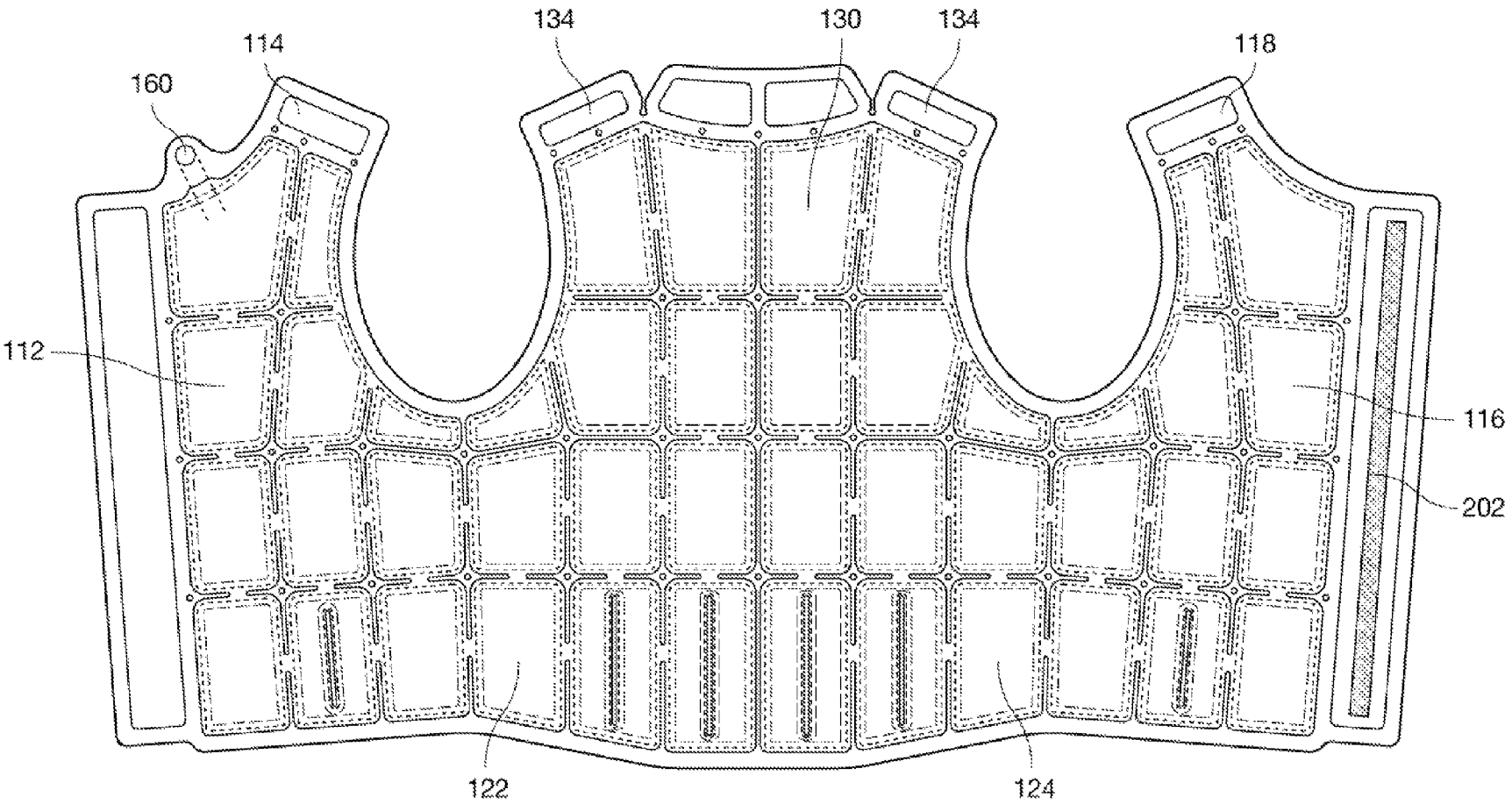
FIG. 3 is a depiction of the vest of the present invention laid out as a flattened single piece.
Figure 4:
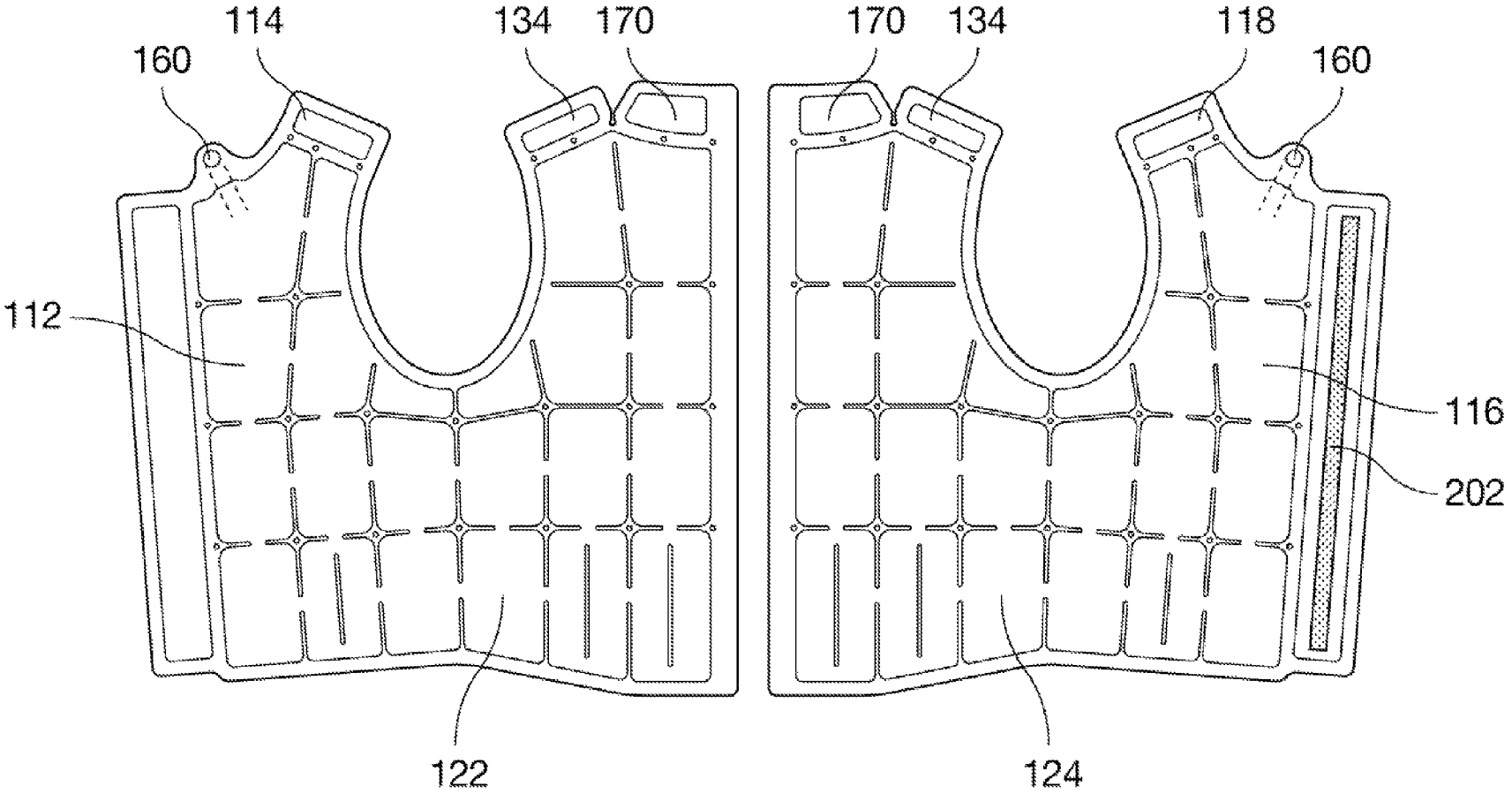
FIG. 4 is a depiction of the vest of the present invention laid out as pair of flattened pieces, to be combined into a single vest during the manufacturing process.

In one embodiment the vest 100 is manufactured as a single part. See FIG. 3. In another embodiment the vest 100 is manufactured in two parts, a left side and a right side. See FIG. 4. The two part manufacturing method requires the left and right sides to be joined together during final assembly. This can be done by a lateral portion of the material of each of the sides being fused together. Alternatively, these portions can be secured together by tape 202 attached to one of the sides engaging with the other side. An advantage of the two part manufacturing process is that the left and right sides are independently inflatable, so a catastrophic loss of integrity on one side will not cause a loss of insulation on the other side.

The part of the vest 100 that is inflatable comprises a plurality of interconnected chambers 180. See FIG. 1. The chambers 180 are located on the upper and lower portions of at least the front 110 of the vest 100 and cross-connected. Preferably, the chambers 180 are located on the upper and lower portions of the front 110, back 130, and sides 122,124 of the vest 100. The inner surface of the vest 100 is on the outside of the chambers 180, and the outer surface of the vest 100 is on the outside of the chambers 180. Each chamber 180 is formed by partially fusing portions of the inner surface and the outer surface of the vest 100 to each other, with the fused portions forming an incomplete perimeter of the chamber 180. The portion of the perimeter not fused communicates with an adjoining chamber 180. Thus, each chamber 180 is in communication with at least one other chamber 180, and at least one chamber 180 is in communication with the inflation tube 160. For vests 100 constructed of two sets of interconnected chambers 180 (see FIG. 4), one inflation tube 160 is required for each.

The inflation tube(s) 160 comprise a simple one-way mouthpiece, for example a flap valve made of the film material of the vest 100 on the vest's collar 170. See FIG. 3. Other configurations of the inflation tube 160 are also contemplated, including an injection molded mouthpiece with an integrated one-way valve. Air introduced into the vest 100 through the inflation tube 160 enters the at least one chamber 180 communicating with it, and passes from that chamber 180 into each other chamber 180 via the communications therebetween until every chamber 180 within the vest 100 contains air. The inflation tube's 160 one-way valve prevents air from escaping the vest 100 during use. The valve may be manipulated, however, to allow air to escape the vest 100, thereby deflating the vest 100 for subsequent use.

One or more of the chambers 180 may have an inter-chamber fusion 182 joining the inner surface of the vest 100 to the outer surface of the vest 100. See FIG. 1. Such chambers 180 thus appear substantially toroid, rather than spherical. The inter-chamber fusions 182 provide structural rigidity to the vest 100, allowing it to retain its desired shape when inflated, thus minimizing the loss of heated air between the wearer and the vest 100 through gapping of the vest 100.

The vest 100 may be provided in a deflated state, flattened out as a single sheet. See FIG. 3. This allows for compact folding for storage purposes. In one embodiment, in order to use the vest 100, the shoulders 126,128 need to be formed and the front 110 needs to be closed. The user thus joins the upper portion 114 of one side of the front 110 of the vest 100 to the upper portion 134 of the corresponding side of the back 130 of the vest 100 to form one shoulder 126, and joins the upper portion 118 of the other side of the front 110 of the vest 100 to the upper portion 134 of the corresponding side of the back 130 of the vest 100 to form the other shoulder 128. In the preferred embodiments each shoulder 126,128 is formed by a tape 202 attached to the upper portion 114 of the front 110 of the vest 100 engaging with the corresponding upper portion 134 of the back 130 of the vest 100. Alternatively, the tape 202 may be attached to the upper portion 134 of the back 130 of the vest 100, and engages with the corresponding upper portion 114 of the front 110 of the vest 100. In either configuration, the tape 202 may further comprise a protective covering on its outside surface, to prevent adhesion prior to use. In other embodiments the shoulders 126,128 are pre-taped or fused during the manufacturing process, and no further action need be taken by the user with regard to the shoulders 126,128 prior to wearing the vest 100.

Figure 2:
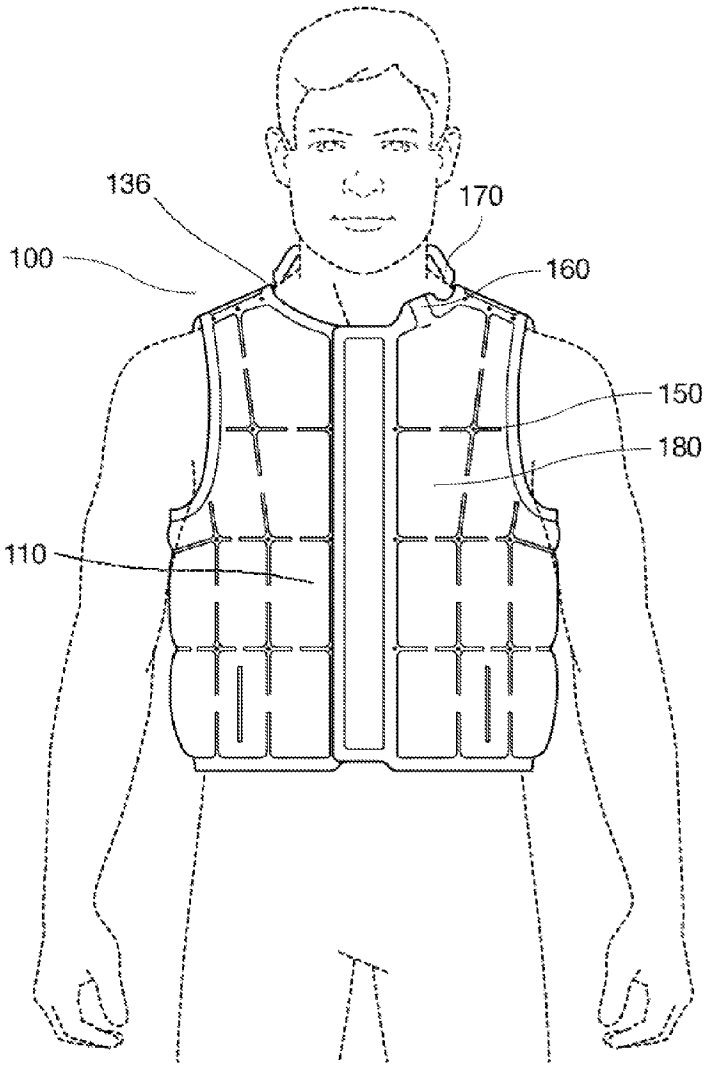
FIG. 2 is a depiction of the embodiment of the vest shown in FIG. 1 as it is intended to be worn, with the vest inflated with air.

The user dons the vest 100 by inserting each arm through a corresponding armhole formed by the side 122, back 130, front 110, and shoulder 126 of the vest 100. Then the front 110 of the vest 100 is closed by bringing one side 112 of the front 110 of the vest 100 into contact with the other side 116 of the front 110 of the vest 100. See FIG. 2. In the preferred embodiments the first side 112 of the front 110 of the vest 100 engages with the second side 116 of the front 110 of the vest 100 by a tape 202, hook and loop fastener (Velcro®), or other adhesive means, which is attached to the first side 112 of the front 110 of the vest 100. It does not matter which side (left or right) has the fastening means attached. If used, the tape 202 may further comprise a protective covering on its outside surface, to prevent adhesion prior to use.

In a preferred embodiment, the vest 100 comprises a radar reflective material on at least a portion of its outer surface. This may be aluminized nylon or other high tensile-strength polyester film metalized on one or both surfaces. The radar reflecting properties of materials such as these are well-established. When inflated, this flexible metalized material forms three-dimensional radar reflective surfaces, presenting much greater reflective opportunity to incident radar waves, and thus aiding in search and rescue operations. In another preferred embodiment, the vest 100 comprises integrated vent holes 150 located in the front 110, sides 122,124, and back 130. These vent holes 150 are punched through the welded vest 100 material at chamber 180 intersections points during the manufacturing process, and allow for greater transfer of moisture from perspiration to the outside of the garment, thereby enhancing wearer comfort and the vest's 100 insulating properties. In yet another preferred embodiment, the vest 100 comprises an integrated inflation tube 160. This tube 160, positioned on the front collar 170, greatly improves the process of vest 100 inflation. In yet another preferred embodiment, the vest 100 comprises a non-inflating integrated collar 170. This collar 170 is produced by fusing both layers of the vest 100 material, thus creating a wind barrier and additional heat reflective surface at the back of the wearer's neck, aiding in overall comfort and utility. In the most preferred embodiment each of these features is incorporated into the vest 100.

Figure 5:
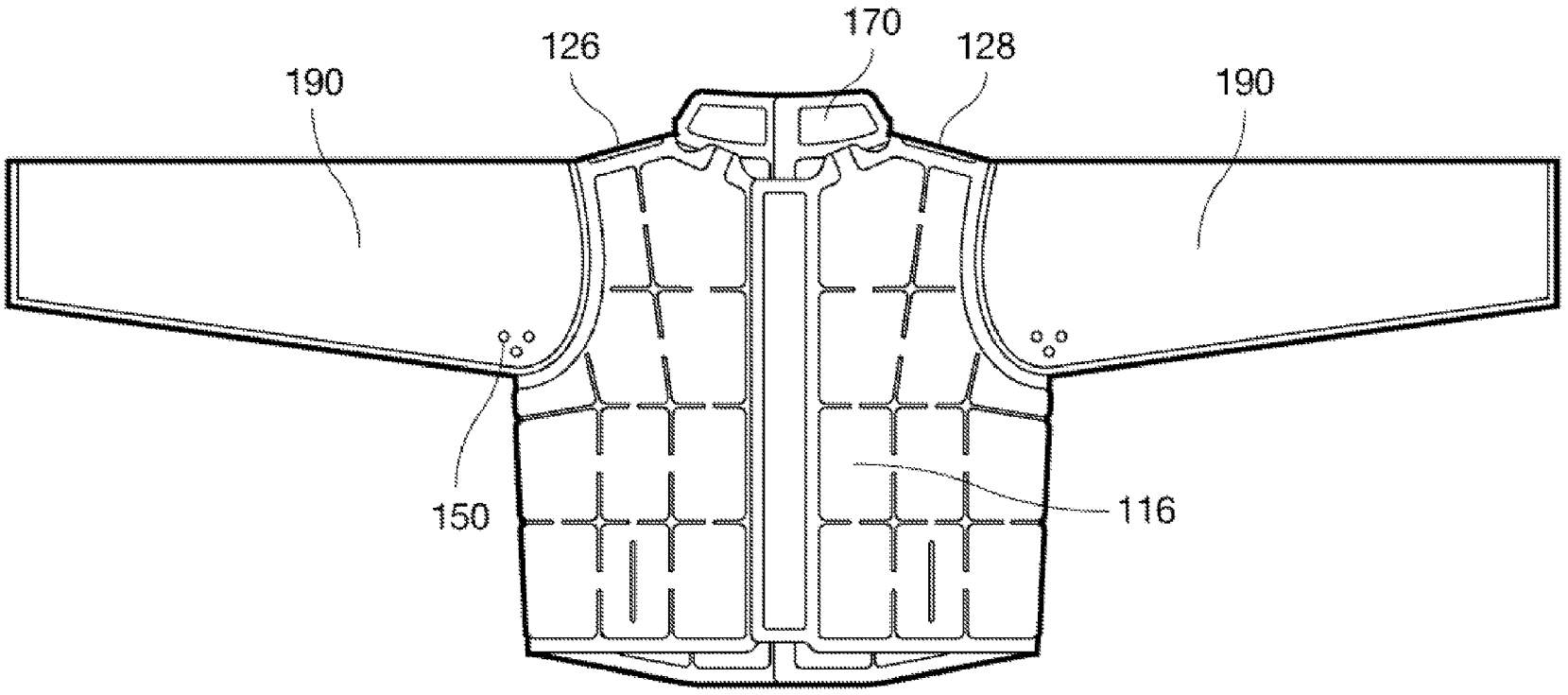
FIG. 5 is a depiction of an embodiment of the present invention in which the vest further comprises non-inflatable sleeves.

In one variant, the vest 100 has a pair of non-inflatable sleeves 190. See FIG. 5. The sleeves 190 are constructed of a single ply of inwardly aluminized material, with vent holes 150 and tape 202 wrist closures. This configuration provides additional insulation to the extremities, while allowing the overall bulk of the vest 100 to remain as small as possible.

What has been described and illustrated herein is a preferred embodiment of the invention along with some it its variations. The terms, descriptions and figures used herein are set forth by way of illustration only and are not meant as limitations. Those skilled in the art will recognize that many variations are possible within the spirit and scope of the invention in which all terms are meant in their broadest, reasonable sense unless otherwise indicated. Any headings utilized within the description are for convenience only and have no legal or limiting effect.

I claim:

1. In a vest of an emergency anti-hypothermia system, improvements comprising at least part of the vest is configured to be inflated by a wearer of the vest, the vest is made with air impervious material to provide the part that is inflatable, and the vest is thermally insulating, with the vest having a thermally insulating closeable front of the vest, a thermally insulating full first side of the vest, a thermally insulating full second side of the vest, a first shoulder, a second shoulder, a first arm hole, a second arm hole, and a thermally insulating full back of the vest from a neck area to a waist area of the vest, with said closeable front being comprised of a first panel and a second panel, with the first and second panels separable from each other in an open state and engageable with each other in a closed state, said full first side being comprised of a single continuous panel, said full second side being comprised of a single continuous panel, said full back being comprised of a continuous panel, said first shoulder comprised of two discontinuous panels and being formed by an upper portion of the first panel of the front of the vest engaging with an upper portion of a first side of the back of the vest, said second shoulder comprised of two discontinuous panels and being formed by an upper portion of the second panel of the front of the vest engaging with an upper portion of a second side of the back of the vest, said first arm hole formed by the first panel of the front of the vest, the first shoulder, the back of the vest, and the full first side of the vest, and said second arm hole formed by the second panel of the front of the vest, the second shoulder, the back of the vest, and the full second side of the vest, with said full first side of the vest being located below the first arm hole and between the first panel of the front of the vest and the back of the vest and said full second side of the vest being located below the second arm hole and between the second panel of the front of the vest and the back of the vest, wherein the vest has an outer surface and an inner surface, with there being thermal radiation reflective material on at least a portion of the inner surface of the vest and radar reflective material on at least a portion of the outer surface of the vest.

2. The vest according to claim 1, further comprising integrated vent holes located in the front, first and second sides, and back of the vest.

3. The vest according to claim 1, further comprising an integrated inflation tube that is configured to be used by the wearer to inflate the vest.

4. The vest according to claim 1, further comprising an integrated collar.

5. The vest according to claim 3, wherein the integrated inflation tube comprises a valve configured to be manipulated in a first mode to allow air to enter the vest and configured to be manipulated in a second mode to allow air to escape from the vest.

6. The vest according to claim 1, wherein the part of the vest that is inflatable comprises chambers, with each said chamber having an interior portion and an exterior portion.

7. The vest according to claim 6, wherein the inner surface of the vest is on the exterior portion of each of the chambers.

8. The vest according to claim 1, wherein the air impervious material of the vest has a thickness no more than 0.014 inches.

9. The vest according to claim 1, further comprising a tape on the front of the vest for closing the vest, the tape having a protective covering on an outside surface of the tape.

10. The vest according to claim 1, further comprising a tape on the upper portion of the first panel of the front of the vest, said tape capable of engaging with the upper portion of the first side of the back of the vest for forming the first shoulder of the vest, the tape having a protective covering on a outside surface of the tape.

11. The vest according to claim 1, further comprising a tape on the upper portion of the first side of the back of the vest, said tape capable of engaging with the upper portion of the first panel of the front of the vest for forming the first shoulder of the vest, the tape having a protective covering on a outside surface of the tape.

12. The vest according to claim 1, further comprising a pair of flexible, non-inflatable sleeves.

13. The vest according to claim 12, wherein each of the sleeves of the vest has an outer surface, an inner surface, and wrist closures, with there being thermal radiation reflective material on at least a portion of the inner surface of said sleeve and radar reflective material on at least a portion of the outer surface of said sleeve, and with the wrist closures configured to provide a snug fit of the sleeves about a user's wrists.

14. The vest according to claim 1, further comprising a hook and loop fastener on the front of the vest for closing the vest.

15. The vest according to claim 1, further comprising a hook and loop fastener with a portion thereof located on an upper portion of a side of the front of the vest and another portion thereof located on an upper portion of a side of the back of the vest, said hook and loop fastener thus capable of joining the front of the vest to the back of the vest to form a shoulder of the vest.

16. The vest according to claim 1, further comprising a tape on the upper portion of the second panel of the front of the vest, said tape capable of engaging with the upper portion of the second side of the back of the vest for forming the second shoulder of the vest, the tape having a protective covering on a outside surface of the tape.

17. The vest according to claim 1, further comprising a tape on the upper portion of the second side of the back of the vest, said tape capable of engaging with the upper portion of the second panel of the front of the vest for forming the second shoulder of the vest, the tape having a protective covering on a outside surface of the tape.

18. In a vest of an emergency anti-hypothermia system, improvements comprising at least part of the vest is configured to be inflated by a wearer of the vest, the vest is made with air impervious material to provide the part that is inflatable, and the vest is thermally insulating, with the vest having a thermally insulating closeable front of the vest, a thermally insulating full first side of the vest, a thermally insulating full second side of the vest, a first shoulder, a second shoulder, a first arm hole, a second arm hole, and a thermally insulating full back of the vest from a neck area to a waist area of the vest, with said closeable front being comprised of a first panel and a second panel, with the first and second panels separable from each other in an open state and engageable with each other in a closed state, said full first side being comprised of a single continuous panel, said full second side being comprised of a single continuous panel, said full back being comprised of a continuous panel, said first shoulder comprised of two discontinuous panels and being formed by an upper portion of the first panel of the front of the vest engaging with an upper portion of a first side of the back of the vest, said second shoulder comprised of two discontinuous panels and being formed by an upper portion of the second panel of the front of the vest engaging with an upper portion of a second side of the back of the vest, said first arm hole formed by the first panel of the front of the vest, the first shoulder, the back of the vest, and the full first side of the vest, and said second arm hole formed by the second panel of the front of the vest, the second shoulder, the back of the vest, and the full second side of the vest, with said full first side of the vest being located below the first arm hole and between the first panel of the front of the vest and the back of the vest and said full second side of the vest being located below the second arm hole and between the second panel of the front of the vest and the back of the vest, wherein the vest has an outer surface and an inner surface, with there being thermal radiation reflective material on at least a portion of the inner surface of the vest and integrated vent holes located in the front, sides, and back of the vest.

19. The vest according to claim 18, further comprising an integrated inflation tube that is configured to be used by the wearer to inflate the vest.

20. The vest according to claim 18, further comprising an integrated collar.

21. The vest according to claim 19, wherein the integrated inflation tube comprises a valve configured to be manipulated in a first mode to allow air to enter the vest and configured to be manipulated in a second mode to allow air to escape from the vest.

22. The vest according to claim 18, wherein the part of the vest that is inflatable comprises chambers, with each said chamber having an interior portion and an exterior portion.

23. The vest according to claim 22, wherein the inner surface of the vest is on the exterior portion of each of the chambers.

24. The vest according to claim 18, wherein the air impervious material of the vest has a thickness no more than 0.014 inches.

25. The vest according to claim 18, further comprising a tape on the front of the vest for closing the vest, the tape having a protective covering on an outside surface of the tape.

26. The vest according to claim 18, further comprising a tape on the upper portion of the first panel of the front of the vest, said tape capable of engaging with the upper portion of the first a side of the back of the vest for forming the first shoulder of the vest, the tape having a protective covering on a outside surface of the tape.

27. The vest according to claim 18, further comprising a tape on the upper portion of the first side of the back of the vest, said tape capable of engaging with the upper portion of the first panel of the front of the vest for forming the first shoulder of the vest, the tape having a protective covering on a outside surface of the tape.

28. The vest according to claim 18, further comprising a pair of flexible, non-inflatable sleeves.

29. The vest according to claim 28, wherein each of the sleeves of the vest has an outer surface, an inner surface, and wrist closures, with there being thermal radiation reflective material on at least a portion of the inner surface of said sleeve and radar reflective material on at least a portion of the outer surface of said sleeve, and with the wrist closures configured to provide a snug fit of the sleeves about a user's wrists.

30. The vest according to claim 18, further comprising a hook and loop fastener on the front of the vest for closing the vest.

31. The vest according to claim 18, further comprising a hook and loop fastener with a portion thereof located on an upper portion of a side of the front of the vest and another portion thereof located on an upper portion of a side of the back of the vest, said hook and loop fastener thus capable of joining the front of the vest to the back of the vest to form a shoulder of the vest.

32. The vest according to claim 18, further comprising a tape on the upper portion of the second panel of the front of the vest, said tape capable of engaging with the upper portion of the second side of the back of the vest for forming the second shoulder of the vest, the tape having a protective covering on a outside surface of the tape.

33. The vest according to claim 18, further comprising a tape on the upper portion of the second side of the back of the vest, said tape capable of engaging with the upper portion of the second panel of the front of the vest for forming the second shoulder of the vest, the tape having a protective covering on a outside surface of the tape.

34. In an emergency anti-hypothermia system comprising a vest, wherein the vest is comprised of a thermally insulating garment, with the garment having a thermally insulating closeable front of the vest, a thermally insulating full first side of the vest, a thermally insulating full second side of the vest, a first shoulder, a second shoulder, a first arm hole, a second arm hole, and a thermally insulating full back of the vest from a neck area to a waist area of the vest, with said closeable front being comprised of a first panel and a second panel, with the first and second panels separable from each other in an open state and engageable with each other in a closed state, said full first side being comprised of a single continuous panel, said full second side being comprised of a single continuous panel, said full back being comprised of a continuous panel, said first shoulder comprised of two discontinuous panels and being formed by an upper portion of the first panel of the front of the vest engaging with an upper portion of a first side of the back of the vest, said second shoulder comprised of two discontinuous panels and being formed by an upper portion of the second panel of the front of the vest engaging with an upper portion of a second side of the back of the vest, said first arm hole formed by the first panel of the front of the vest, the first shoulder, the back of the vest, and the full first side of the vest, and said second arm hole formed by the second panel of the front of the vest, the second shoulder, the back of the vest, and the full second side of the vest, with said full first side of the vest being located below the first arm hole and between the first panel of the front of the vest and the back of the vest and said full second side of the vest being located below the second arm hole and between the second panel of the front of the vest and the back of the vest, wherein at least part of the garment is configured to be inflated by a wearer of the vest and is made of an air impervious material, the part that is inflatable comprises a plurality of chambers, each chamber defined by internal and external surfaces, wherein at least one of the chambers is an upper chamber and at least one of the chambers is a lower chamber, with each lower chamber located below each upper chamber when the vest is being worn and with at least one upper chamber and at least one lower clamber located on the front of the vest and cross-connected with each other, and the vest has an outer surface and an inner surface, with there being thermal radiation reflective material on at least a portion of the inner surface of the vest, radar reflective material on at least a portion of the outer surface of the vest, integrated vent holes located in the front, first and second sides, and back of the vest, an integrated inflation tube, and an integrated collar, wherein the vest is configured to be carried in a pocket for emergency use.

35. The vest according to claim 34, further comprising a tape on the front of the vest for closing the vest, the tape having a protective covering on an outside surface of the tape.

36. The vest according to claim 34, further comprising a tape on the upper portion of the first panel of the front of the vest, said tape capable of engaging with the upper portion of the first side of the back of the vest for forming the first shoulder of the vest, the tape having a protective covering on a outside surface of the tape.

37. The vest according to claim 34, further comprising a tape on the upper portion of the first side of the back of the vest, said tape capable of engaging with the upper portion of the first panel of the front of the vest for forming the first shoulder of the vest, the tape having a protective covering on a outside surface of the tape.

38. The vest according to claim 34, wherein the inner surface of the vest is on the external surface of each of the chambers.

39. The vest according to claim 34, wherein the air impervious material of the vest has a thickness no more than 0.014 inches.

40. The vest according to claim 34, further comprising a pair of flexible, non-inflatable sleeves.

41. The vest according to claim 40, wherein each of the sleeves of the vest has an outer surface, an inner surface, and wrist closures, with there being thermal radiation reflective material on at least a portion of the inner surface of said sleeve and radar reflective material on at least a portion of the outer surface of said sleeve, and with the wrist closures configured to provide a snug fit of the sleeves about a user's wrists.

42. The vest according to claim 34, further comprising a hook and loop fastener on the front of the vest for closing the vest.

43. The vest according to claim 34, further comprising a hook and loop fastener with a portion thereof located on an upper portion of a side of the front of the vest and another portion thereof located on an upper portion of a side of the back of the vest, said hook and loop fastener thus capable of joining the front of the vest to the back of the vest to form a shoulder of the vest.

44. The vest according to claim 34, further comprising a tape on the upper portion of the second panel of the front of the vest, said tape capable of engaging with the upper portion of the second side of the back of the vest for forming the second shoulder of the vest, the tape having a protective covering on a outside surface of the tape.

45. The vest according to claim 34, further comprising a tape on the upper portion of the second side of the back of the vest, said tape capable of engaging with the upper portion of the second panel of the front of the vest for forming the second shoulder of the vest, the tape having a protective covering on a outside surface of the tape.

* * * * *